US011519199B2

(12) United States Patent
Lanzelotti

(10) Patent No.: US 11,519,199 B2
(45) Date of Patent: Dec. 6, 2022

(54) BAR HANDLE WITH INCORPORATED LOCK

(71) Applicant: M. ARTHUR GENSLER, JR. & ASSOCIATES, INC., New York, NY (US)

(72) Inventor: Thomas A. Lanzelotti, New York, NY (US)

(73) Assignee: M. ARTHUR GENSLER, JR. & ASSOCIATES, INC., New York, NY (US)

( * ) Notice: Subject to any disclaimer, the term of this patent is extended or adjusted under 35 U.S.C. 154(b) by 175 days.

(21) Appl. No.: 16/838,612

(22) Filed: Apr. 2, 2020

(65) Prior Publication Data

US 2021/0310280 A1 Oct. 7, 2021

(51) Int. Cl.
*E05B 55/00* (2006.01)
*E05B 65/10* (2006.01)
*E05B 1/00* (2006.01)

(52) U.S. Cl.
CPC ..... *E05B 55/005* (2013.01); *E05B 1/0038* (2013.01); *E05B 65/1086* (2013.01)

(58) Field of Classification Search
CPC ..... E05B 1/0038; E05B 55/005; E05B 65/10; E05B 65/1046; E05B 65/1053; E05B 65/1086
See application file for complete search history.

(56) References Cited

U.S. PATENT DOCUMENTS

| | | | | |
|---|---|---|---|---|
| 5,823,582 | A * | 10/1998 | Frolov | E05B 65/1053 292/92 |
| 6,511,104 | B1 * | 1/2003 | Horgan, Jr. | E05B 65/106 292/336.3 |
| 7,070,210 | B2 * | 7/2006 | Lin | E05B 65/104 292/92 |
| 7,849,718 | B2 * | 12/2010 | Ambrass | E05B 65/0025 70/92 |
| 8,528,946 | B2 * | 9/2013 | Shen | E05B 65/1053 292/92 |
| 8,851,530 | B2 * | 10/2014 | Geringer | E05B 65/1053 292/92 |
| 10,072,444 | B2 * | 9/2018 | Lehner, Jr. | E05B 65/1053 |
| 10,844,637 | B2 * | 11/2020 | Yalamati | E05B 65/1053 |
| 2009/0183538 | A1 * | 7/2009 | Peng | E05B 65/1053 70/92 |

* cited by examiner

*Primary Examiner* — Christopher J Boswell
(74) *Attorney, Agent, or Firm* — Cantor Colburn LLP

(57) ABSTRACT

A bar handle with incorporated lock having a tubular element for gripping a handle, installed on a face of a door by way of interposition of at least one spacer element, and
a lock which is at least partially contained inside the tubular element. The handle includes a release device for releasing the lock, which is configured to be operated manually with a pusher element installed on the tubular element.
the handle comprises a release device for releasing the lock, which is configured to be operated manually with a pusher element installed on the tubular element.

9 Claims, 5 Drawing Sheets

BAR HANDLE WITH INCORPORATED LOCK

TECHNICAL FIELD

The present disclosure relates to a bar handle with incorporated lock.

BACKGROUND

Bar handles with incorporated locks are nowadays widespread and are particularly adapted to be applied to glass doors, often of offices, public places and commercial concerns, both on sliding doors and on leaf doors.

Typically such handles comprise:

- two tubular gripping elements, on opposite faces of a same door, each extending longitudinally and being typically positioned vertically,
- spacer elements which are adapted to support and connect the tubular element with the door; typically such spacer elements have an extension perpendicular to that of the tubular element.

The two gripping bars and the spacer elements are positioned on opposite faces of a same door at corresponding positions. In the present description reference is made to a "first tubular element" in order to indicate the grip element on the face of the door adapted to be directed toward the outside of the room in the closed configuration, and to a "second tubular element" in order to indicate the element on the face of the same door which is adapted to be directed toward the inside of the room, again in the closed configuration.

Locking elements are contained inside the tubular elements and spacer elements, for joining to each other and for connection to the door.

Normally, in bar handles with an incorporated lock, a cylinder with a security key is arranged in one of the spacer elements of the first gripping bar, while a device for actuating the lock is arranged in the corresponding spacer element of the second gripping bar.

The elements of the lock are placed typically in the tubular element of the second bar, the bar inside the room.

Such elements of the lock comprise an upper tip element and/or a lower tip element, which is/are adapted to be inserted into a corresponding dead hole located on the door threshold area.

Each tip element is moved by a rack element with which it is integral, optionally with the interposition of a transmission element/bar.

The rack element, in turn, is moved by a gearwheel which can be operated both by the cylinder and by the actuation knob.

The coupling between the gearwheel and the rack element converts the circular movement of the cylinder and/or of the actuation knob to a linear movement of the tip element.

The movement of the cylinder is generally transmitted to the gearwheel via a shaft, with which the two components are integral, while the movement of the knob is transmitted to the gearwheel via a pin, with which they are integral.

Such handles, although nowadays widespread, have a drawback in that in order to open a door that has been locked, the tip elements must be retracted from the corresponding dead holes by rotating the key in the cylinder or by rotating the lock actuation knob. These operations are not immediate and on the contrary are an impediment if the user needs to rapidly get outside, especially in emergency situations.

Furthermore, such operations are even more difficult for users with reduced motor capacities. As prescribed by the ADA2010 regulations, which defines the standard known as "the 2010 ADA Standard for Accessible Design", the usable parts must be capable of being actuated with one hand and without forcibly gripping, tightening or turning. The force required to activate the usable parts must be a maximum of 5 pounds (22.2 N).

SUMMARY

The aim of the present disclosure is to provide a bar handle that can improve the known art in one or more of the above mentioned aspects.

Within this aim, the disclosure provides a bar handle that enables the user to rapidly open the door even if it is locked.

The disclosure also provides a bar handle that is easy to use.

The disclosure further provides a bar handle that can be installed both on sliding doors and on leaf doors.

The disclosure provides a handle that is highly reliable, easy to implement and of low cost.

This aim and these and other advantages which will become better apparent hereinafter are achieved by providing a bar handle with incorporated lock, which comprises:

- a tubular element, for gripping said handle, installed on a face of a door leaf by way of interposition of:
- at least one spacer element,
- a lock which is at least partially contained inside said tubular element, said handle being characterized in that it comprises a release device for releasing said lock, which is configured to be operated manually with a pusher element installed on said tubular element.

BRIEF DESCRIPTION OF THE DRAWINGS

Further characteristics and advantages of the disclosure will become better apparent from the detailed description of a preferred, but not exclusive, embodiment of the bar handle according to the disclosure, which is illustrated, by way of non-limiting example, in the accompanying drawings wherein.

DETAILED DESCRIPTION OF THE DRAWINGS

Figure 1:
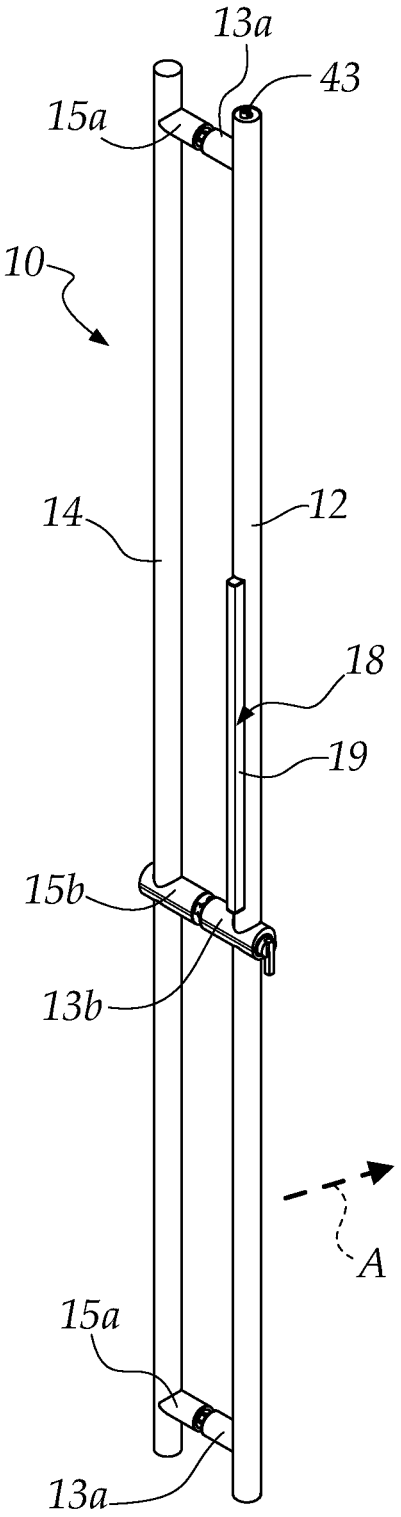
FIG. 1 is a perspective view of a bar handle according to the disclosure in the locked configuration.

With reference to FIGS. 1-8, the handle according to the disclosure, generally designated by the reference numeral 10, comprises:

- a tubular element 12, for gripping the handle 10, installed on the face of a door leaf by way of interposition of:

at least one spacer element 13, three in the case shown, a lock 11 which is at least partially contained inside the tubular element 12.

The tubular element 12 and the spacer elements 13 are installed on the door leaf of the door which is directed toward the inside of the environment in which it is installed.

The tubular element 12 is installed in the vertical position.

The handle 10 comprises, on the opposite face of the same door leaf, another tubular element 14 and at least one other spacer element 15, three installed correspondingly to the previously-mentioned elements.

The spacer elements 13 and 15 are substantially tubular as well and are installed perpendicular to the tubular elements 12 and 14 in order to support and connect the latter items to the door.

For each tubular element there are three spacer elements, at different heights, since the tubular elements are installed vertically.

In particular, in the embodiment shown, there are first spacer elements 13*a* near the opposite ends of the tubular element 12 and a second spacer element 13*b* at a height comprised between the range of the two heights of the other spacer elements 13*a*, within which a device 16 for actuating the lock 11 is installed.

Figure 6:
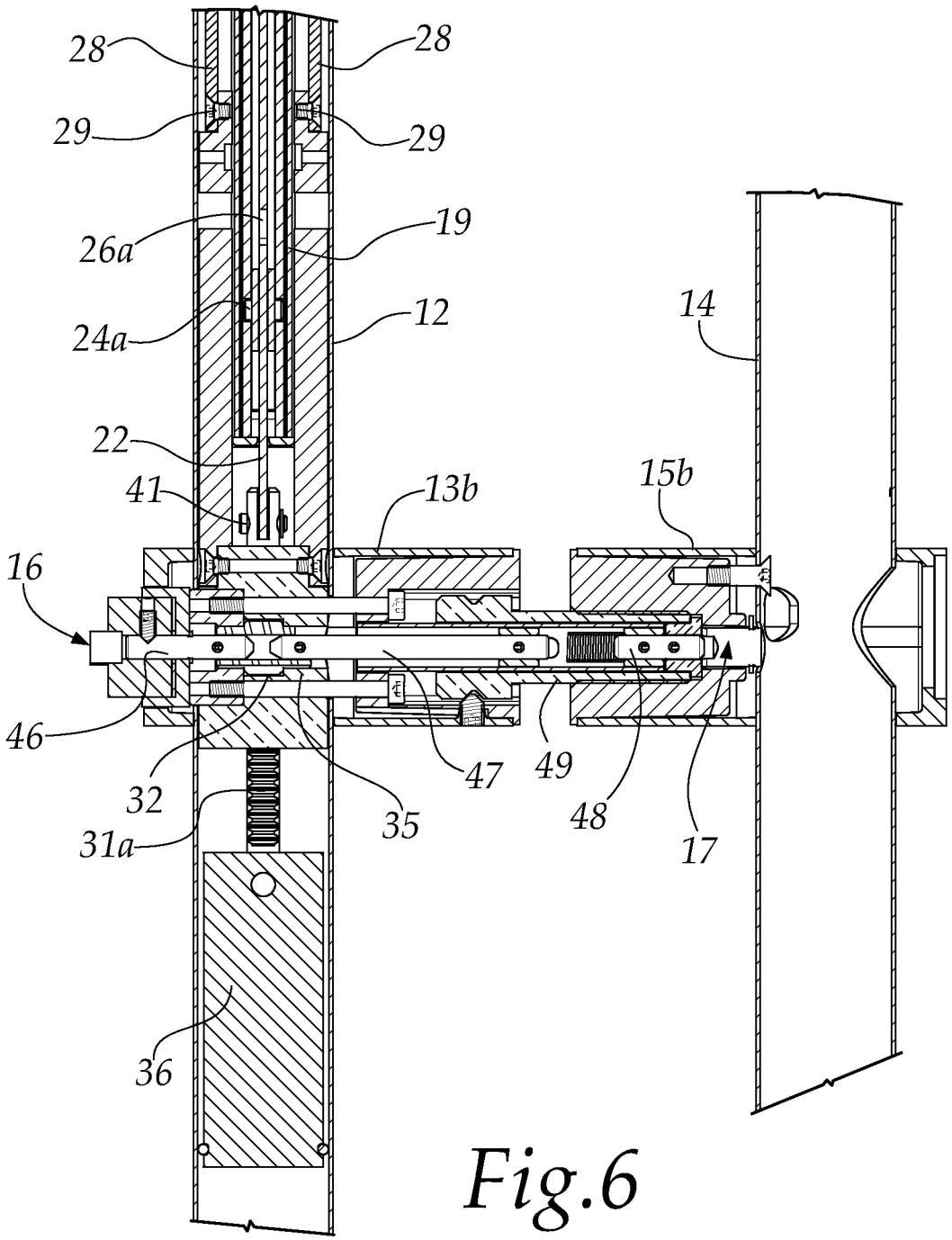
FIG. 6 is a cross-sectional view of a part of the lock.

Two first spacer elements 15*a* are installed near the opposite ends of the tubular element 14, while a second spacer element 15*b* is installed correspondingly to the second spacer element 13*b* which supports the device 16, this element 15*b* being provided with a receptacle 17 for a key-operated cylinder, as indicated in FIG. 6.

Figure 2:
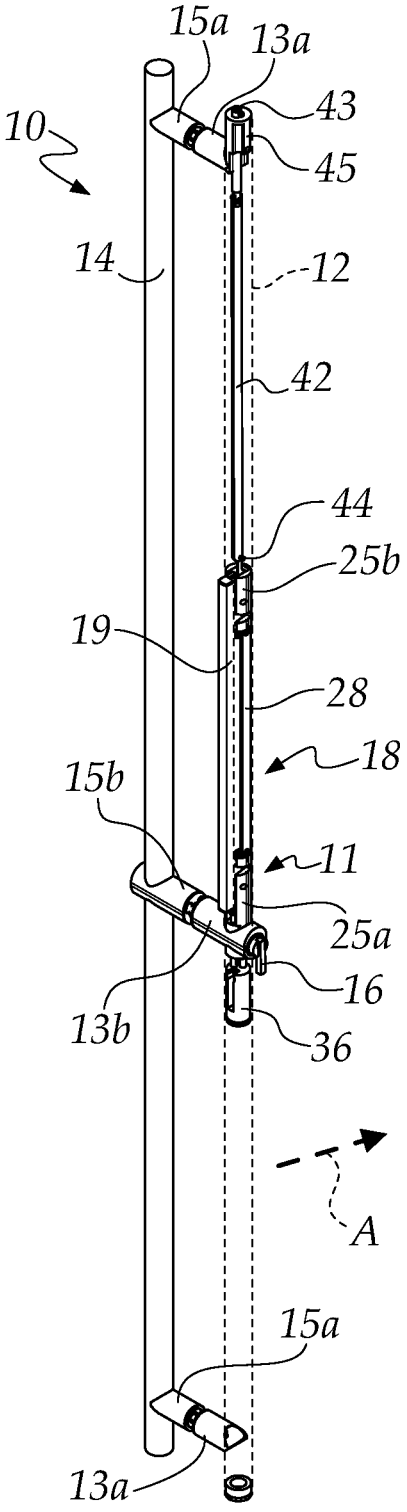
FIG. 2 shows a bar handle as in FIG. 1, in which the release device inside the tubular element is made partially visible.

The bar handle 10 according to the disclosure can be installed both on leaf doors and on sliding doors, in the latter case when the sliding is to the right, with respect to what is shown in FIGS. 1 and 2 where the direction of sliding is indicated with the arrow A. The direction of thrust is the same as the direction of movement of the (sliding) door.

The bar handle 10 comprises a release device 18 for releasing the lock 11, which can be operated manually with a pusher element 19 installed on the tubular element 12, on the face of the door leaf facing inwards.

The pusher element 19 includes a bar operated by a button recessed mechanically inside a special seat, as a result of a manual push to unlock the lock 11.

The pusher element 19 is a vertical bar with a C-shaped profile in cross-section and with the cavity directed toward the inside of the tubular element 12, where a profiled element 20, also C-shaped in cross-section, is associated. The pusher element 19 and the profiled element 20 are mutually coupled, in the manner described below. In the cavity of the profiled element 20 there is a longitudinally-extended plate-like slider 22, and on these two there are slots 21 and 23 with pins 24 which pass transversely through them both and are fixed with respect to the tubular element 12, and on the slider 22 there are slots 26 with pins 27 coupled to the profiled element 20, their ends being inserted into the holes 52. Such slots 21, 23 and 26 and pins 24 and 27 guide the translation of the profiled element 20 and the slider 22 within the tubular element 12.

In particular, on the sides of the profiled element 20 there are two mirror-symmetrical pairs of horizontal slots 21, a first, lower horizontal pair 21*a* and a second, upper horizontal pair 21*b*.

In turn, positioned within the cavity of such profiled element 20 is the slider 22, which has a first vertical slot 23*a* at the first pair of horizontal slots 21 of the profiled element 20 and a second vertical slot 23*b* at the second pair of horizontal slots 21*b*. The first pair of horizontal slots 21*a* and the first vertical slot 23*a* are passed through simultaneously by a same first pin 24*a*, while the second pair of horizontal slots 21*b* and the second vertical slot 23*b* are passed through simultaneously by a same second pin 24*b*. The pins 24*a* and 24*b* are adapted to slide horizontally in the first 21*a* and second 21*b* pairs of slots, and at the same time vertically in the slots 23*a* and 23*b*. With the pins 24*a* and 24*b* respective bushings 37 made of brass are provided.

The bar handle 10 also comprises a lower support 25*a* and an upper support 25*b* within the tubular element 12.

The pins 24*a* and 24*b* are fixed respectively in the lower support 25*a* and in the upper support 25*b*.

On the slider 22 there are also two oblique slots, first 26*a* and second 26*b*, respectively in a lower position and an upper position, between the two aforementioned first and second vertical slots 23*a* and 23*b*, with positive inclination toward the inside.

Such oblique slots 26*a* and 26*b* are passed through by a first pin 27*a* and by a second pin 27*b* respectively, which are held in place between the opposite faces of the profiled element 20. With the pins 27*a* and 27*b* bushings 38 made of brass are provided.

The lower support 25*a* and the upper support 25*b* are connected by a pair of parallel rods 28 which are fixed at their ends with screws 29 to the two supports 25*a*, 25*b*. The two bars 28, in addition to being parallel, are also spaced apart and the slider 22 is installed between them.

Figure 7:
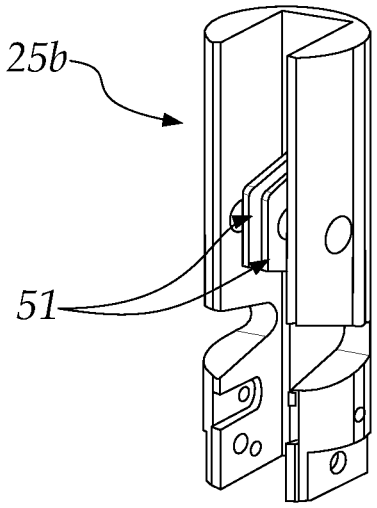
FIG. 7 is a perspective view of an element of the handle according to the disclosure.
Figure 8:
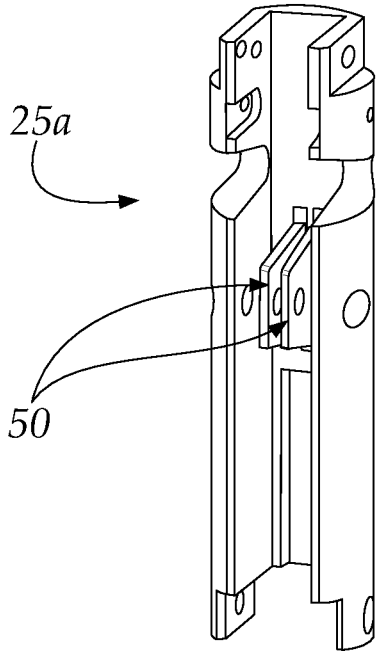
FIG. 8 is another perspective view of the element of the handle according to the disclosure.

The two supports 25*a* and 25*b* are substantially C-shaped in cross-section, with the opening directed outward, i.e. toward the pusher element 19, so as to allow a horizontal translation, toward the inside of such element, of the profiled element 20 and of the slider 22. Such supports 25*a* and 25*b* are shown individually in the respective FIGS. 7 and 8. In particular, FIG. 7 shows the upper support 25*b* and FIG. 8 shows the lower support 25*a*.

The two supports 25*a* and 25*b* have respective pairs of tabs 50 and 51 for guiding the slider 22 and which constrain the respective pins 24*a* and 24*b*.

Figure 3:
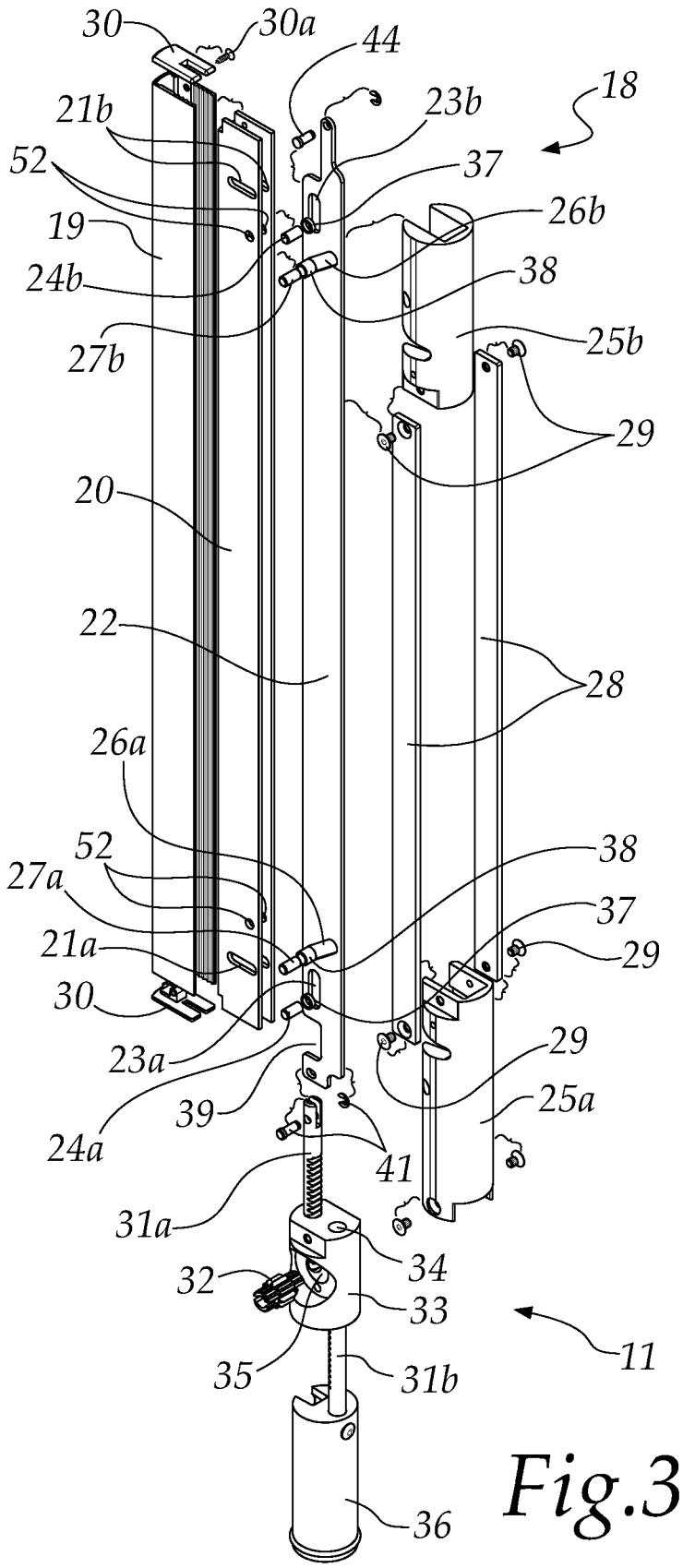
FIG. 3 is an exploded perspective view of a part of the release device.
Figure 4:
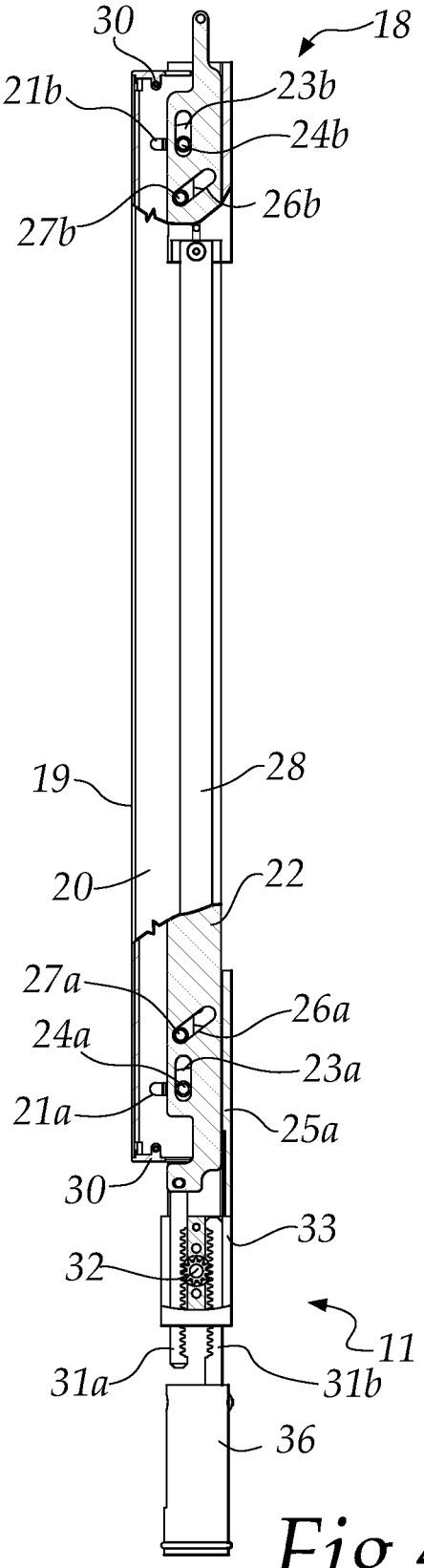
FIG. 4 is a cross-sectional view of the part of the release device shown in FIG. 3, in the locked configuration.
Figure 5:
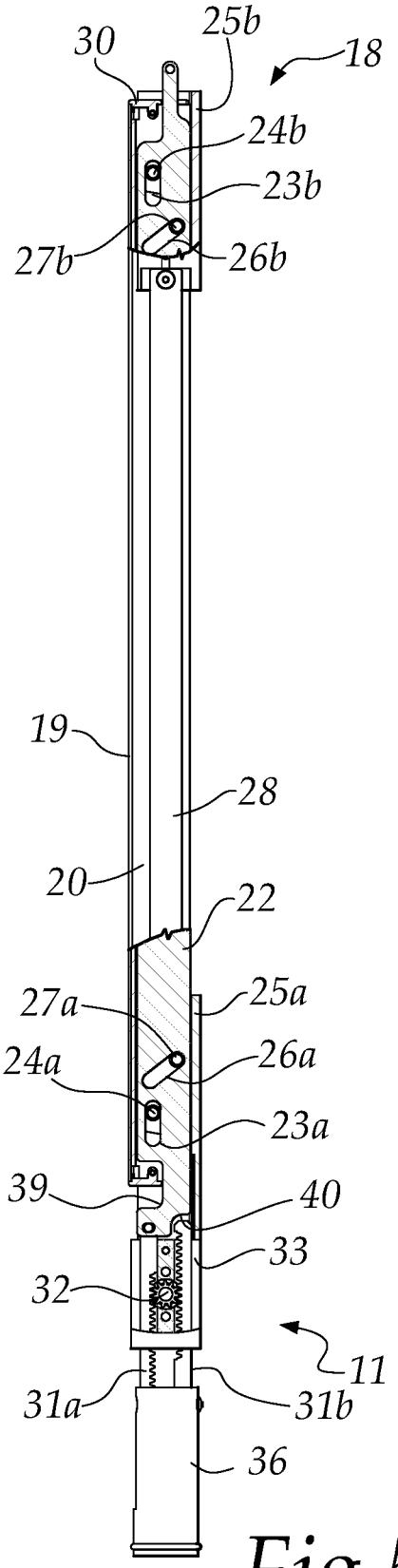
FIG. 5 shows the part of the release device as in FIG. 4, in the unlocked configuration.

As shown in FIGS. 3 to 5, the slider 22 has extensions at its ends, for which there are two covers 30 which close the ends of the profiled element 20 and which are U-shaped, with a slit that allows the two extensions to protrude at the opposite ends of the profiled element 20.

As anticipated, the pusher element 19 and the profiled element 20 are mutually coupled: this is obtained with screws 30*a*, one at each end, which pass through the element 19, the profiled element and the respective covers 30 in adapted holes.

At the lower end, the slider 22 is provided with an indentation 39, indicated in FIG. 3, which allows the profiled element 20 to perform a horizontal stroke during the pushing of the element 19.

At the lower end the slider 22 is coupled to a first rack element 31*a* of the lock 11, by way of a pin with a C-clip 41.

The lock 11 comprises a gearwheel 32, with its rotation axis parallel to and/or coincident with the axis of extension of the second spacer element 13*b*, and which is connected both to the device 16 and to the receptacle 17 of the cylinder, as better described below.

The gearwheel 32 is arranged inside a receptacle 33, which is arranged at the intersection between the through holes of the second spacer element 13*b* and of the tubular element 12.

The gearwheel 32 interacts with two mutually opposing rack elements of the lock 11: the first rack element 31*a* and the second rack element 31*b*.

The slider 22 is also provided with a recess at the lower end, indicated in FIG. 5 with the reference numeral 40, which allows the lifting of the second rack element 31*b* induced by the activation of the release device 18, during the pushing of the element 19, bringing such rack element 31*b* with the upper end into the recess 40.

The receptacle 33 has a substantially cylindrical body with two through holes 34 in which the two rack elements 31*a* and 31*b* pass through it lengthwise in the vertical direction.

Between the two through holes 34 there is another hole 35, with its axis perpendicular to the previous axes, in which the gearwheel 32 is installed. The hole 35 intercepts the through holes 34, thus the two rack elements 31*a* and 31*b* mesh in diametrically opposite positions on the teeth of the gearwheel 32.

The first rack element 31*a* is coupled with the upper end thereof to the lower end of the slider 22, while the second rack element 31*b* is coupled with the lower end thereof to a counterweight 36.

The part of the lock 11 with the device 16 and the receptacle 17 of the cylinder is described below.

As shown in FIG. 2, the handle 10 also comprises, inside the tubular element 12, a transmission rod 42 which is coupled with its upper end to a tip element 43 and with its lower end to the release device 18, being pivoted to the upper end of the slider 22, by way of a pin 44.

The lock 11 comprises a per se known guide 45 in which the tip element 43 is adapted to slide, and which is accommodated inside the tubular element 12. The tip element 43 protrudes from the guide 45 and from the tubular element 12 in the closed configuration of the lock 11, as shown in FIG. 1 and in FIG. 2.

FIG. 6 shows a part of the lock 11, in the open configuration, at the device 16 and the receptacle 17 of the cylinder.

This part is substantially per se known.

The gearwheel 32 is mounted on a first pivot 46 and on a shaft 47, which are aligned head-to-head along the axis of rotation of the wheel and are accommodated inside the second spacer element 13*b*. A second pivot 48 is accommodated inside the second spacer element 15*b*, aligned with the previous pivots along the same axis. The second pivot 48 is positioned head-to-head with the shaft 47 within a threaded tubular receptacle 49 which connects the two spacer elements 13*b* and 15*b* by passing through the door leaf of the door.

By way of a series of tubular receptacles which, in a conventional manner, are mutually connected and installed in the two spacer elements 13*b* and 15*b*, the key-operated cylinder and the device 16 are integral. In fact, a rotation imparted to the key inside the cylinder causes the rotation of the first pivot 46 and therefore of the gearwheel 32, as happens with the rotation of the knob 16.

The gearwheel 32 with the rack elements 31*a* and 31*b* convert the circular movement of the cylinder and/or of the actuation knob to a linear movement which is transmitted to the rest of the lock.

Operation of the handle, according to the disclosure, is as follows.

The handle 10 is installed, in a per se known manner, in a vertical position on the door leaf of a door with the tubular element 12 on the face thereof facing the inside of the room and the other tubular element 14 on the opposite face and correspondingly to the former.

When the lock 11 is closed, the tip element 43 protrudes from above, externally from the guide 45 and from the tubular element 12, as shown in FIG. 1 and in FIG. 2, in order to be inserted into a dead hole which is conveniently present on the door threshold area.

The mechanism for opening and closing the lock 11 and the operation of the release device 18 is clear, in particular, in FIGS. 4 and 5.

Pushing the pusher element 19, the release device 18 is activated: the profiled element 20 is pushed toward the inside of the tubular element 12.

The horizontal translation of the profiled element 20 determines the vertical translation of the slider 22, downward in the case shown: such elements are moved with respect to the pins 24*a*, 24*b* and 27*a*, 27*b*, and are guided by the vertical slots 23*a* and 23*b*, horizontal slots 21*a* and 21*b*, and oblique slots 26*a*, 26*b*.

The slider 22 performs a translational motion, pulling the transmission rod 42, which in turn brings the tip element 43 to translate downward in the guide 45, thus freeing the dead hole on the door threshold area.

Lowering the slider 22 also determines the lowering of the first rack element 31*a*, which in turn rotates the gearwheel 32 and the device 16.

In a similar manner, the release of the lock occurs in fact by rotating the device 16 or the cylinder using the key.

In practice it has been found that the disclosure fully achieves the intended aim and advantages by providing a quick-release bar handle that is easy to use, with a single manual pushing action, in the same direction of travel as the door, similarly to panic bars installed horizontally on leaf doors.

It should also be noted that the handle can easily be used by persons with limited motor capacities and in particular by persons who have difficulty moving their hands, it being unnecessary to grasp or turn knobs, handles or other actuation devices in order to obtain the release of the lock.

It should also be noted that the release device in the handle is capable of reducing the force to be applied on the pusher element and at the same time maximizing the travel of the tip element.

Also, it should be noted that the handle according to the disclosure is installable on sliding doors but also on leaf doors.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A bar handle with incorporated lock, which comprises:

a tubular element, for gripping said handle, installed on a face of a door by way of interposition of:

at least one spacer element extending substantially perpendicular to the tubular element, a lock which is at least partially contained inside said tubular element, said handle comprising a release device for releasing said lock, which is configured to be operated manually with a pusher element installed on said tubular element, wherein the release device is positioned in the at least one spacer element.

2. The bar handle according to claim 1, wherein said pusher element is a vertical bar with a C-shaped profile in cross-section and with the cavity directed toward the inside of said tubular element, where a profiled element, also C-shaped in cross-section, is associated, in the cavity of said profiled element there being a longitudinally-extended plate-like slider, on said profiled element and on said slider there being slots with pins which pass transversely through them both and are fixed with respect to said tubular element, and on said slider there being slots with pins coupled to said profiled element, said slots and said pins acting to guide the translation of said profiled element and said slider within said tubular element.

3. The bar handle according to claim 2, wherein on sides of said profiled element there are two mirror-symmetrical pairs of horizontal slots, a first, lower horizontal pair and a second, upper horizontal pair.

4. The bar handle according to claim 3, wherein said longitudinally-extended plate-like slider has a first vertical slot at said first pair of horizontal slots of said profiled element and a second vertical slot at said second pair of horizontal slots, said first pair of horizontal slots and said first vertical slot being passed through simultaneously by a same first pin, said second pair of horizontal slots and said second vertical slot being passed through simultaneously by a same second pin.

5. The bar handle according to claim 2, wherein on said longitudinally-extended plate-like slider there are a first and a second oblique slots, which are passed through respectively by a first pin and by a second pin.

6. The bar handle according to claim 2, further comprising a lower support and an upper support which are connected by way of a pair of parallel rods which are spaced apart, said longitudinally-extended plate-like slider being installed between said lower support and said upper support.

7. The bar handle according to claim 2, further comprising a gearwheel which interacts with two mutually opposite rack elements, a first rack element coupled with an upper end thereof to a lower end of said longitudinally-extended plate-like slider and a second rack element coupled with a lower end thereof to a counterweight.

8. The bar handle according to claim 1, further comprising a transmission rod inside said tubular element, which is coupled with a first end thereof to a tip element and with a second end thereof to said release device.

9. The bar handle according to claim 8, wherein said lock comprises a guide within which said tip element is adapted to slide.

* * * * *